United States Patent [19]

Knotik et al.

[11] 4,203,863

[45] May 20, 1980

[54] PROCESS FOR THE PRODUCTION OF SOLID PARTICLES

[75] Inventors: Karl Knotik, Eisenstadt; Peter Leichter; Emil Proksch, both of Vienna, all of Austria; Hans Huschka, Hanau, Fed. Rep. of Germany

[73] Assignee: Nukem GmbH, Hanau, Fed. Rep. of Germany

[21] Appl. No.: 891,383

[22] Filed: Mar. 29, 1978

[30] Foreign Application Priority Data

May 24, 1977 [AT] Austria ..... 3696/77

[51] Int. Cl.[2] ..... G21F 9/08

[52] U.S. Cl. ..... 252/301.1 W; 34/1; 34/4; 159/3; 159/DIG. 12; 159/DIG. 26

[58] Field of Search ..... 252/301.1 W; 261/128; 159/3, DIG. 12, DIG. 26; 204/157.1 R, 157.1 H; 34/1, 4

[56] References Cited

U.S. PATENT DOCUMENTS 3,726,774 4/1973 Difford et al. ..... 204/157.1 R

FOREIGN PATENT DOCUMENTS 2012785 10/1971 Fed. Rep. of Germany .
1520681 4/1968 France ..... 252/301.1 W
2132912 11/1972 France ..... 159/DIG. 26

*Primary Examiner*—Benjamin R. Padgett
*Assistant Examiner*—Deborah L. Kyle
*Attorney, Agent, or Firm*—Cushman, Darby & Cushman

[57] ABSTRACT

There is disclosed a process for the production of solid particles of bioinjurious waste, e.g., radioactive concentrates, wherein a liquid, and in a given case a binder containing waste is divided into drops and supplied energy in a gaseous medium, the liquid is evaporated and the drops form solid particles. There is supplied carrier free energy to at least partially vaporize the liquid of the drops, in a given case under reduced pressure and in a given case with a binder forming solid particles from the drops.

10 Claims, No Drawings

PROCESS FOR THE PRODUCTION OF SOLID PARTICLES

BACKGROUND OF THE INVENTION

The invention is directed to a process for the production of solid particles from liquid bioinjurious waste, e.g., radioactive concentrates, which can serve for storage or as intermediate product for storable particles.

There are already known a number of processes by which liquid waste concentrates can be converted into a storable form. Most processes start by separating off the non-toxic liquid, e.g., water and supplying the solids remaining behind either with or without a further treatment to storage.

The simplest of these processes consists of evaporating the concentrate in a container to dryness whereupon the container with the solids is closed and is supplied to a storehouse. This drying in a container is described in German Pat. Nos. 1,564,276 and 1,614,071. The disadvantage of this process is that as a rule the solids are corrosive and frequently are even hygroscopic salts so that there occures a corrosion of the container after a shorter or longer time which can only be partially avoided by the use of stainless steel containers. This solution is expensive and dry bioinjurious waste obtained in this manner is present partialy in finely divided structure so that in further handling or storage of the waste there can be caused partially a contamination, e.g., by leaching out or otherwise burdening the environment.

Furthermore, there are also known processes in which the water is tied up in the tank or container. To these below the known cementation process as well as the bitumenization after adsorption on solid materials (Hanss, German Os No. 2,421,142). The disadvantages of such processes correspond to those previously described. Additionally, at higher active waste content there occurs increased radiolysis of the tied up water whereby combustible or explosive gases are formed.

Furthermore, it is known to dry concentrates of bioinjurious (i.e., biotoxic) waste in a so-called thin layer evaporator whereby likewise pourable solid residues are sought. The solids deposit in the inside of the thin layer evaporator so that a proper apparatus for shearing off the solids is required. These solids, however, are of different natures and adhere partially so strongly to the inner surfaces that the strength of the wiper blades, scraper or the like frequently is not sufficient and these are damaged. This type of damage to the apparatus can only be eliminated by considering particular precautionary measures since the solid residues can exert an injurious effect on the service personnel. In Dollgast German Pat. No. 1,764,586, furthermore, there is described the employment of roller dryers for treatment of concentrates injurious to the environment. To the advantage of the reduced final volume, however, there is the disadvantage of the ability to leach out as well as likewise occurring waste air problems.

It is also known to employ bitumenization screws for the treatment of environmentally injurious concentrates, e.g., see Meier German OS No. 2,361,732. The advantages of the continuous process and the utilization of the volume are opposed by the extraordinarily disadvantageous accumulation of oily and contaminating liquids being evaporated.

A further process for the treatment of radioactive concentrate containing liquid waste materials is described in German Pat. No. 2,012,785. In this process there is added bone glue or a similarly acting binder to the radioactive concentrate and it is converted by spray drying into solid residues or granulates. For spray drying there is used hot air or another suitable gas which after the drying is freed from dust and with cooling freed from water in order to then in a closed cycle to again be heated up and be fed to the spray drying. In this process there result consequently two different groups of solid residues. On the one hand, those which accumulate in the space in which the spray drying is carried out and on the other hand those which are obtained in the subsequent removal of dust from the gases. The solid residues obtained in the removal of dust are powdery and very finely divided so that they dust very easily and thereby can again cause a load on the environment.

SUMMARY OF THE INVENTION

The invention has the object of providing a process for the production of solid particles from bioinjurious waste in which the above mentioned disadvantages are avoided. The process of the invention for the production of solid particles fro bioinjurious waste, e.g., radioactive concentrates, wherein a liquid, and in a given case binder containing waste is divided into drops and supplied energy in a gaseous medium and the liquid is evaporated and solid particles are formed from the drops consists essentially of supplying carrier free energy to at least partially evaporate the liquid of the drops, in a given case under reduced pressure, and in a given case forming with a binder solid particles from the drops. Consequently, it is therefore possible according to the invention to divide into drops liquid waste mixtures, if necessary together with organic and/or inorganic binders, as e.g., natural or synthetic glue, synthetic resins or their components, silicates, e.g., sodium silicate or potassium silicate, borates, e.g., sodium borate or potassium borate, etc., by means of a nozzle or the like and to change these drops into solid particles at reduced pressure or at normal pressure in a gaseous, nonturbulent atmosphere during the falling to the bottom by supplying carrier free energy. An evaporation of the solvent can be caused by the supplying of energy or there can be attained a removal of the binder. In the use of synthetic resins as binder there are particularly suited as binders phenol and urea resins, e.g., phenol-formaldehyde, cresol-formaldehyde, resorcinol-formaldehyde and urea formaldehyde. These are employed in the form of their components, e.g., phenol, resorcinol and/or urea or melamine or in the form of precondensates of the dissolved starting materials and dissolved therein. As hardening agent there is added an aqueous formaldehyde solution (e.g., a 40% solution) and in a given case a catalyst, for example, a mineral acid, e.g., hydrochloric acid or sulfuric acid, shortly before dropping the starting mixture out of the nozzle. Also by emulsifying in hydrophobic materials, as for example bitumen, polyethylene, polystyrene, etc., there can be produced with heating of the drops a protective coating of the particle surface.

A further possibility is to coat the surface of the dropping drops, for example, by supplying a synthetic resin emulsion based on a silicone or similar compound in the dropping through a concentric double nozzle. Among others, for example, the waste solution can be mixed with a phenolic resin component and be brought together with a reactive gas, in this case, for example, formaldehyde vapor. There is formed a surface resin layer. According to an additional form of the process of the invention the energy is supplied by radiation, particularly IR rays. This type of energy carrier permits a particularly simple apparatus solution which is of particular significance directly in connection with the working up of bioinjurious waste since thereby maintenance and repair work can be held especially low.

According to a further form of the process of the invention, the energy is supplied by microwaves. The frequency region with aqueous solution is varied between 8–40 giga Hertz (gHz) depending on the size of the drops. By these means an especially simple heating of the drops can be attained, even in the interior of the drops so that there is caused a uniform and quick escape of the liquid.

The energy for drying the drops can additionally be supplied by electron beams, gamma rays in which case on the one hand there is present a dependence on the binder and on the other hand on the construction and length of the apparatus which can be between two and eight meters. The range of the energy spectrum is arranged according to the type of liquid, the binder added and according to the size of the drops.

It has proven especially advantageous to work with a drop size of approximately 0.5–5 mm. With this size of drops on the one hand it can be safely established that the solid drops obtained do not dust and on the other hand that solid, discrete particles are obtained which are particularly suited for a further working up.

Unless otherwise indicated all parts and percentages are by weight.

The process can comprise, consist essentially of or consist of the steps set forth and the materials can comprise, consist essentially of or consist of those set forth.

The invention will be explained further in connection with the examples.

DESCRIPTION OF THE PREFERRED EMBODIMENTS

EXAMPLE 1

A radioactive aqueous waste concentrate solution which contained per liter of concentrate

| | |
|---|---|
| $NaBO_2$ | 200 grams |
| $KNO_3$ | 10 grams |
| $CaCl_2$ | 10 grams |
| $Na_3PO_4$ | 5 grams |

and radioactive impurities was divided by a nozzle into drops between 0.5 and 5 mm and subsequently converted by drying into solid particles. It is not necessary to add a binder to this waste concentrate solution since the borate acts as such. The nozzle is arranged at the upper end of an essentially tubular shaped apparatus in which the drops falls to the bottom. A slightly reduced pressure prevails in the inside so that no toxic materials can go out of the apparatus and simultaneously the evaporation of the water is made easier. Air serves as the gaseous medium. The energy was supplied by an infrared (IR) emitter whose maximum output was between 3 and 6$\mu$. The use of an IR laser is also possible. The steam is condensed at a suitable condenser. The finely divided, dust-free particles collected at the lower end of the apparatus are present in discrete form and are outstandingly suited for embedding, e.g., in bitumen, concrete, synthetic resin or the like.

EXAMPLE 2

There was provided a radioactive aqueous waste concentrate suspension which contained per liter

| | |
|---|---|
| $Fe(OH)_3$ | 14 grams |
| $CaSO_4$ | 28 grams |
| $Ca_3(PO_4)_2$ | 21 grams |
| $MgSO_4$ | 11 grams |
| $Na_2SO_4$ | 37 grams |
| $CaCl_2$ | 15 grams |
| $FeCl_3$ | 31 grams |

traces of radioactive compounds and as a binder 170 grams of resorcinol, 10 grams of cyclohexane sulfamic acid and 55 grams of formaldehyde in the form of a 40% aqueous solution. This suspension was worked up in accordance with Example 1 wherein the energy supply took place through microwaves having a frequency range between 8 and 40 GHz (Giga hertz). The amount of binder was so chosen that dust-free particles were obtained which did not disintegrate in the drying process.

The thus obtained finely divided dust-free particles in discrete form likewise are outstandingly suitable both for direct storage and also for further working or for coating with pyrolytic carbon, metals, metal compounds such as SiC.

EXAMPLE 3

A radioactive aqueous waste concentrate having a high content of a washing agent which had the following content per liter

| | |
|---|---|
| $Fe(OH)_3$ | 15 grams |
| NaCl | 30 grams |
| Surface Active Agent | 10 grams |
| $NaBO_2 \cdot H_2O_2$ | 55 grams |
| Hand Washing Paste | 20 grams |
| Sodium Polyphosphate | 25 grams |

traces of radioactive compounds and as a binder 50 grams of polyvinyl alcohol were further worked up in the manner described in Example 1 wherein the energy supply was carried out both with the IR emitter mentioned in Example 1 and also the microwaves mentioned in Example 2. The solid particles obtained were finely divided and present in discrete form and were outstandingly suited both for further working up and also for direct storage.

At the bottom of the tubular apparatus the particles can, for example, be introduced directly into a suitable embedding material whereby there can be attained a particularly small load on the environment.

With particles which result from radioactive waste concentrates having higher radioactivity a post solidification, e.g., carbonization of organic binder by a further thermal treatment, for example, in a fluidized bed can be advantageous. These particles can then for example be subjected to a further coating in the fluidized bed whereby there are particularly suited as coating materials metals, metal compounds, pyrolytic carbon or SiC. This type of coated particles can then be embedded in metal, glass or ceramic to protect the environment. An embedding in metals, e.g., lead, tin or aluminum alloys is of particular advantage because of the high thermal conductivity with strong radioactive materials.

Alternatively to embedding the particles obtained according to Examples 1–3, likewise they can be supplied as such in a container to a suitable storage so that the particles cement to a block through a corresponding choice of surface coating, for example, by emulsifying with bitumen, polyethylene or polystyrene in the final storage container.

What is claimed is:

1. A process for the production of solid particles of bioinjurious radioactive liquid waste comprising dividing the waste into drops and supplying energy to the drops in a non-turbulent gaseous medium to evaporate the liquid, the energy being supplied by irridiation, to form solid dust-free particles from the drops.

2. The process of claim 1 wherein the waste also includes a binder.

3. The process of claim 2 wherein the binder is a phenol-formaldehyde resin which is hardened in situ while irradiating the waste concentrate particles.

4. The process of claim 1 wherein the irradiation comprises IR rays.

5. The process of claim 1 wherein the energy supply comprises microwaves.

6. The process of claim 1 wherein the energy supply comprises ionizing irradiation.

7. The process of claim 6 wherein the irradiation comprises an electron beam.

8. The process of claim 1 wherein the drops have a particle size of approximately 0.5 to 5 mm.

9. The process of claim 8 wherein the energy is supplied by IR rays, microwaves, or an electron beam.

10. The process of claim 1 wherein the particles are coated with a binder and are agglomerated into a non-leachable block in a final storage container.

* * * * *